US005431466A

United States Patent [19]

Richardson, Jr.

[11] Patent Number: 5,431,466

[45] Date of Patent: Jul. 11, 1995

[54] APPARATUS FOR PULLING CORES

[75] Inventor: Thomas D. Richardson, Jr., Cleveland, Ohio

[73] Assignee: G. R. Osterland Company, Cleveland, Ohio

[21] Appl. No.: 291,576

[22] Filed: Aug. 16, 1994

Related U.S. Application Data

[60] Division of Ser. No. 93,963, Jul. 21, 1993, abandoned, which is a continuation-in-part of Ser. No. 906,361, Jun. 30, 1992, Pat. No. 5,328,221.

[51] Int. Cl.[6] ..... A01B 1/00

[52] U.S. Cl. ..... 294/50.7; 73/864.44; 294/50.8

[58] Field of Search ..... 294/15, 16, 28, 31.2, 294/33, 50–50.9, 90, 91, 99.1, 103.1, 119.1, 119.2; 37/302; 73/864.44, 864.45, 864.51; 111/92, 100, 101, 106; 172/21, 22; 175/20, 244, 249, 403

[56] References Cited

U.S. PATENT DOCUMENTS

| | | | |
|---|---|---|---|
| 42,391 | 4/1864 | Milo | 294/50.7 X |
| 68,903 | 9/1867 | Roberts | 294/50.8 |
| 273,181 | 2/1883 | Spitznass | 294/50.7 X |
| 370,482 | 9/1887 | Johnson | 294/50.8 |
| 383,629 | 5/1888 | Coon | 294/50.7 |
| 588,833 | 8/1897 | Overbey | 294/50.5 |
| 607,519 | 7/1898 | Millar | 294/50.7 |
| 684,010 | 10/1901 | Thalheimer | 294/50.7 |
| 811,301 | 1/1906 | Kline | 294/50.7 X |
| 816,236 | 3/1906 | Kline | 294/50.7 X |
| 1,021,984 | 4/1912 | Holmes | 294/90 |
| 1,038,924 | 9/1912 | Matthews | 294/50.7 X |
| 1,109,446 | 9/1914 | Melberg | 294/50.7 |
| 1,407,232 | 2/1922 | Stevens | 294/50.9 X |
| 1,451,199 | 4/1923 | Blair | 294/90 |
| 1,553,665 | 9/1925 | Bergsten | 294/90 |
| 1,618,568 | 2/1927 | Carlson | 294/16 |
| 1,847,136 | 3/1932 | Rauberstrauch | 73/864.44 X |
| 2,294,542 | 9/1942 | Chulick et al. | 294/28 X |
| 2,593,924 | 4/1952 | Rothkamm | 294/50.7 X |
| 2,686,073 | 8/1954 | Benoist | 294/50.9 X |
| 2,831,720 | 4/1958 | Renfroe | 294/31.2 |
| 2,863,258 | 12/1958 | Gish | 294/50.7 X |
| 2,989,335 | 6/1961 | North | 294/50.7 X |
| 2,994,551 | 8/1961 | Garnett | 294/15 |
| 2,999,714 | 9/1961 | Ritchie | 294/31.2 |
| 3,284,932 | 11/1966 | Wendlandt | 294/50.7 X |
| 3,461,192 | 8/1969 | Di Stasio | 73/864.44 X |
| 3,471,192 | 10/1969 | Childs et al. | 294/50.7 |
| 3,817,435 | 6/1974 | De Luca et al. | 294/31.2 X |
| 4,834,441 | 5/1989 | Schivley | 294/90 |
| 5,004,282 | 4/1991 | Perry | 294/16 |
| 5,328,221 | 7/1994 | Richardson, Jr. | 294/50.7 |

*Primary Examiner*—Johnny D. Cherry
*Attorney, Agent, or Firm*—Foley & Lardner

[57] ABSTRACT

An apparatus and method for removing cores from a material to be tested includes a first split shell having a first split portion, a tightening device for moving confronting ends of the first shell towards each other so that the shell grips the core to be pulled, and a handle for pulling the core. The core puller is inserted into a space left by a drill bit. The core puller is tightened around the core to be pulled, and the core is then pulled.

1 Claim, 4 Drawing Sheets

APPARATUS FOR PULLING CORES

This application is a division of application Ser. No. 08/093,963, filed Jul. 21, 1993 now abandoned, which in turn is a continuation-in-part of application Ser. No. 07/906,361, filed Jun. 30, 1992 now U.S. Pat. No. 5,329,221.

BACKGROUND OF THE INVENTION

The present invention relates in general to an apparatus and method for obtaining test cores, and in particular to an apparatus and method for obtaining test cores from concrete and asphalt pavement.

In the paving industry, highway and street authorities and engineers, as well as private engineers on parking lots, require that paving contractors drill out sample cores of pavement after it has been sufficiently cured. These cores are subjected to standard tests to verify the composition and hardness of the pavement. This method is used for both asphalt and concrete paving. The core samples are generally obtained by using a vertical core drill which drills out a core of the material using a tubular diamond-tipped bit driven by a gas or electric drill. The cores generally vary from 1½ inches in length and are of varying diameters (depending on the preference of the testers).

To test the cores and obtain results that are representative of the pavement in general, it is important to keep the cores intact. Several methods presently used to extract sample cores are: 1) drilling a second identical core hole next to the sample core hole, chipping out the second core hole and then getting under the sample core with a lever and prying it out; 2) driving a pair of rods through the surrounding material and prying out the core; and 3) digging a wedge-shaped hole next to the core and prying it out. These methods are unsatisfactory, however, because the resulting sample core is often not intact. The methods are time consuming, and when the core sample is damaged, the process must be repeated. The problem of obtaining undamaged core samples has been a problem since the beginning of post-paving core testing.

SUMMARY OF THE INVENTION

It is an object of the present invention to provide an apparatus and method for obtaining test cores that are undamaged.

It is another object of the invention to provide an apparatus and method for obtaining test cores that are quick to use.

It is a further object of the invention to provide an apparatus and method for obtaining test cores which can be used with industry standard drill bits for taking core samples from pavement.

These and other objects and advantages of the present invention are realized in one embodiment by a core puller comprising a first split shell, including a first split portion; at least one handle attached to the first shell, and a first tightening device for moving confronting ends of the first shell towards each other, the first tightening device being located on an upper part of the first shell.

The method of the present invention includes the steps of providing a core puller, inserting the core puller into a space located around a core to be pulled, tightening the core puller around the core, and pulling the core.

BRIEF DESCRIPTION OF THE DRAWINGS

The present invention may be understood from the description of the preferred embodiments which follows and from the accompanying drawings. The drawings are hereby expressly made a part of the specification.

DETAILED DESCRIPTION OF THE PREFERRED EMBODIMENTS

Figure 1:
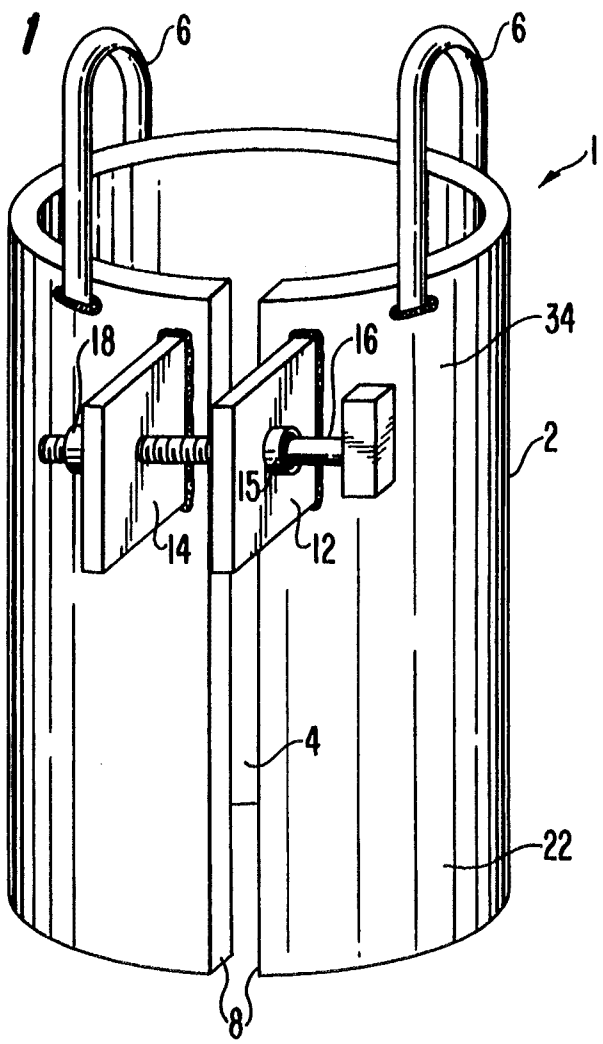
FIG. 1 is a perspective view of a first embodiment of the invention.

Referring first to FIG. 1, a first embodiment of the core puller 1 of the present invention includes a first split cylindrical shell 2 having a first split portion 4 and at least one handle 6. A tightening device for moving confronting ends 8 of the first shell 2 towards each other includes brackets 12, 14, clamping screw 16, and nut 18. The brackets 12, 14 are mounted on an upper part 34 of the shell 2 so that the lower part 22 of the shell is free from external obstructions, thereby allowing insertion of the lower part 22 into the cylindrical space created by the drill bit. All of the components of the core puller can be made of, for example, steel.

The diameter of the shell 2 can be varied according to the size of the drill bit used to drill out the core samples. One standard bit presently in use in the industry is approximately 6 inches in diameter; therefore, a diameter of the shell 2 can be approximately 6 inches.

The length of the unobstructed lower part 22 is varied according to the depth of the cores to be pulled. Generally, the length of the lower part 22 is varied from 2 to 6 inches, but other lengths are possible. The thickness of the shell 2 must be slightly less than the thickness of the standard drill bit. Steel plate of 3/22 inch thickness can be used to make the shell 2 as this thickness will fit in the cylindrical space left by a standard drill bit. The handles 6 can be made from ⅜ inch round stock and formed in a U-shape.

The brackets 12, 14 are provided with holes for receiving the clamping screw 16. The clamping screw and nut arrangement can be any of those known in the art whereby when the clamping screw 16 is rotated, the nut 18 advances on the clamping screw and the brackets 12, 14 are forced towards each other. The arrangement of FIGS. 1–2 includes a positioning nut 15 welded to the clamping screw 16. Plate washers (not shown) are provided on both sides of the bracket 12. One washer is placed between the bracket 12 and the nut 15 and the second washer is placed on the opposite side of the bracket 12 and welded to the clamping screw 16. The nut 18 is welded to the bracket plate 14, and the clamping screw 16 is threaded through the nut 18. The clamping screw 16 may conveniently be provided with a T-shaped handle for ease of manual operation. As the clamping screw 16 is tightened, a force is applied to the brackets 12, 14 by way of the nuts 15, 18.

Because the brackets 12, 14 are rigidly mounted on the shell 2, the force is transmitted to the shell 2 so that confronting ends 8 of the shell are moved towards each other and the shell 2 grips the core sample to be pulled. As the shell 2 grips the core sample, the shell 2 undergoes elastic deformation. After the shell has been tightened around the core sample, the core puller and the intact core sample are pulled from the surrounding material using the handle 6. Thereafter, the clamping screw 16 can be loosened and the intact core sample removed from the core puller. As the clamping screw 16 is loosened, the shell 2 elastically returns to its relaxed condition.

Figure 3:
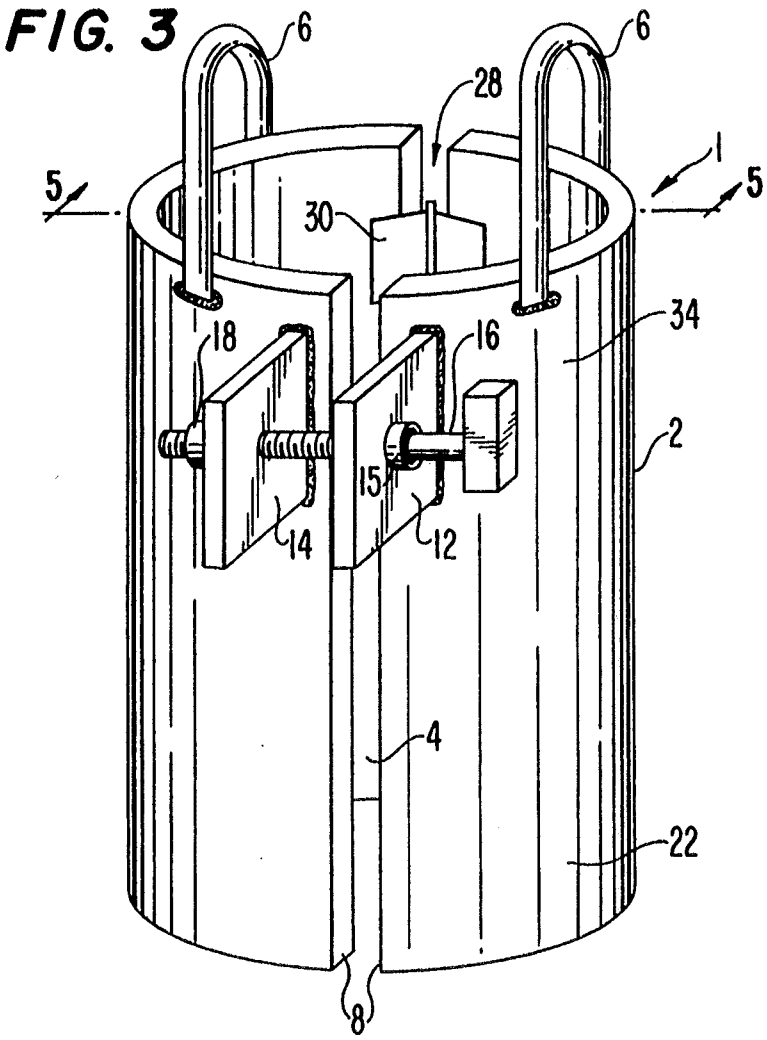
FIG. 3 is a perspective view of a third embodiment of the invention.
Figure 5:
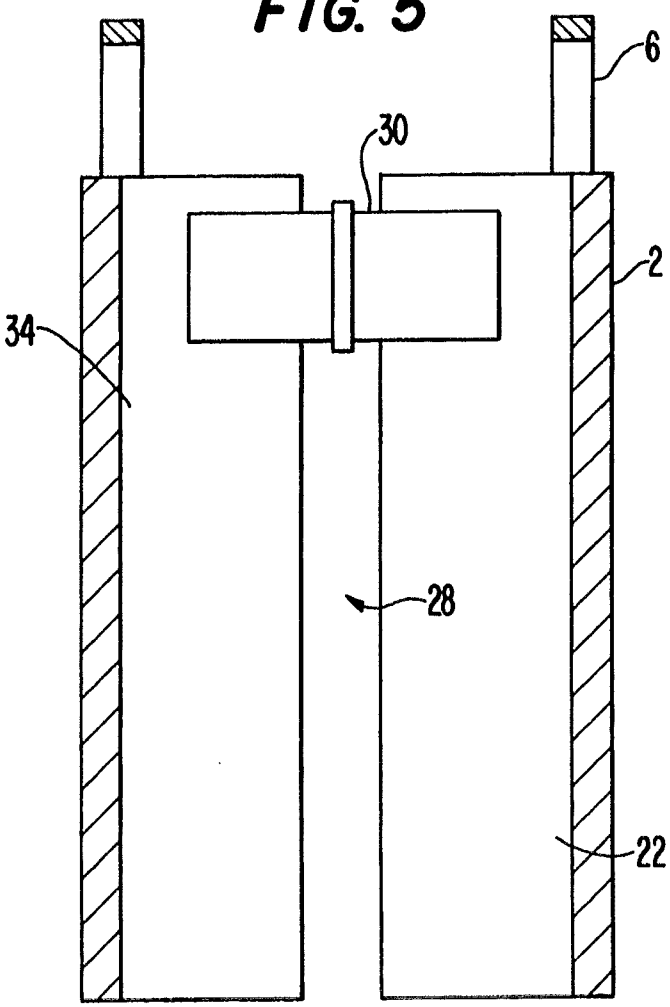
FIG. 5 is a cross-sectional view taken along the plane 5—5 of FIG. 3.

FIGS. 3 and 5 show an embodiment which is a modification of the first embodiment of FIG. 1. The modification depicted in FIG. 3 includes a third split portion 28 located on the first shell 2 opposite the first split portion 4, and a hinge 30 located at the third split portion 28 and attached to an interior surface of the upper part 34 of the first shell. It is possible to locate the third split portion 28 at various positions on the first shell 2, rather than opposite the first split portion 4.

The operation of the embodiment shown in FIGS. 3 and 5 differs from the operation of the first embodiment of FIG. 1 in that, with the hinge 30, it is not necessary to elastically deform the shell 2 in order to grip the core sample. Rather, the hinge 30 allows the shell to simply grip the core sample as the clamping screw 16 is tightened. Commercially available hinges can be used for the hinge 30.

As shown in FIGS. 3 and 5, the hinge 30 is mounted on the internal surface of the shell 2, but could also be mounted on the external surface of the shell 2. Whether mounted internally or externally on the shell 2, the hinge 30 should be mounted on the upper part 34 of the shell so that the lower part 22 remains unobstructed for insertion into the cylindrical space left by the drill bit.

Figure 2:
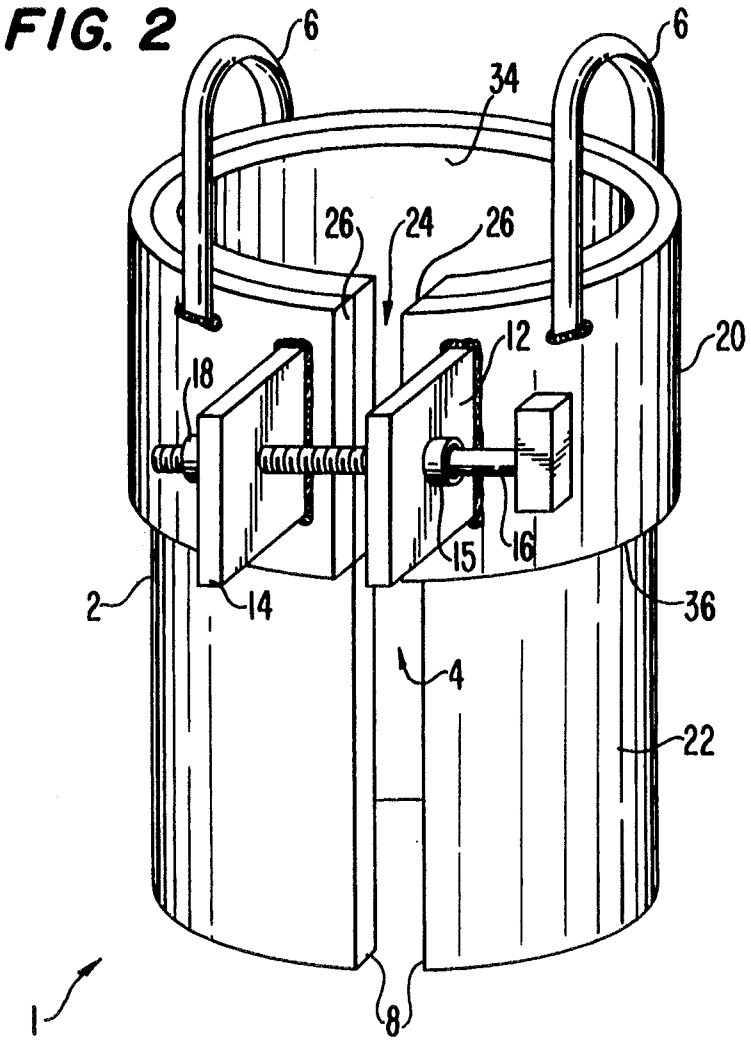
FIG. 2 is a perspective view of a second embodiment of the invention.

Referring now to FIG. 2, a second embodiment of the present invention is shown wherein the reference numerals used to describe the first embodiment represent similar components in the second embodiment.

The second embodiment further includes a second split cylindrical shell 20 attached to an outer surface of the upper part 34 of the first shell. The second shell 20 has a diameter greater than the diameter of the first shell. The second shell is fitted over and around the upper part of the first shell so that a lower part 22 of the first shell projects beyond a lower end 36 of the second shell. The second shell 20 has a second split portion 24 in substantial alignment with the first split portion 4. A tightening device for moving confronting ends 26 of the second shell towards each other includes brackets 12, 14, clamping screw 16 and nut 18. The operation of the clamping screw 16, nut 18, and brackets 12, 14 is similar to that of the first embodiment. The lower part 22 of the first shell 2 is made a length which depends on the depth of the cores to be pulled. This length is conveniently made to be 2 to 6 inches.

The operation of the second embodiment according to FIG. 2 is similar to that of the first embodiment according to FIG. 1. The core puller is inserted into the cylindrical space left by the drill bit. The clamping screw 16 is then tightened thereby causing the first shell 2 to grip the core sample. The core sample and core puller are then pulled using the handles 6. The clamping screw 16 is loosened and the intact core sample is removed from the core puller.

In the embodiment of FIG. 2, both the first shell 2 and the second shell 20 elastically deform to tighten around the core sample. When the sample has been pulled and the clamping screw 16 loosened, the shells 2 and 20 elastically return to their relaxed position.

Figure 4:
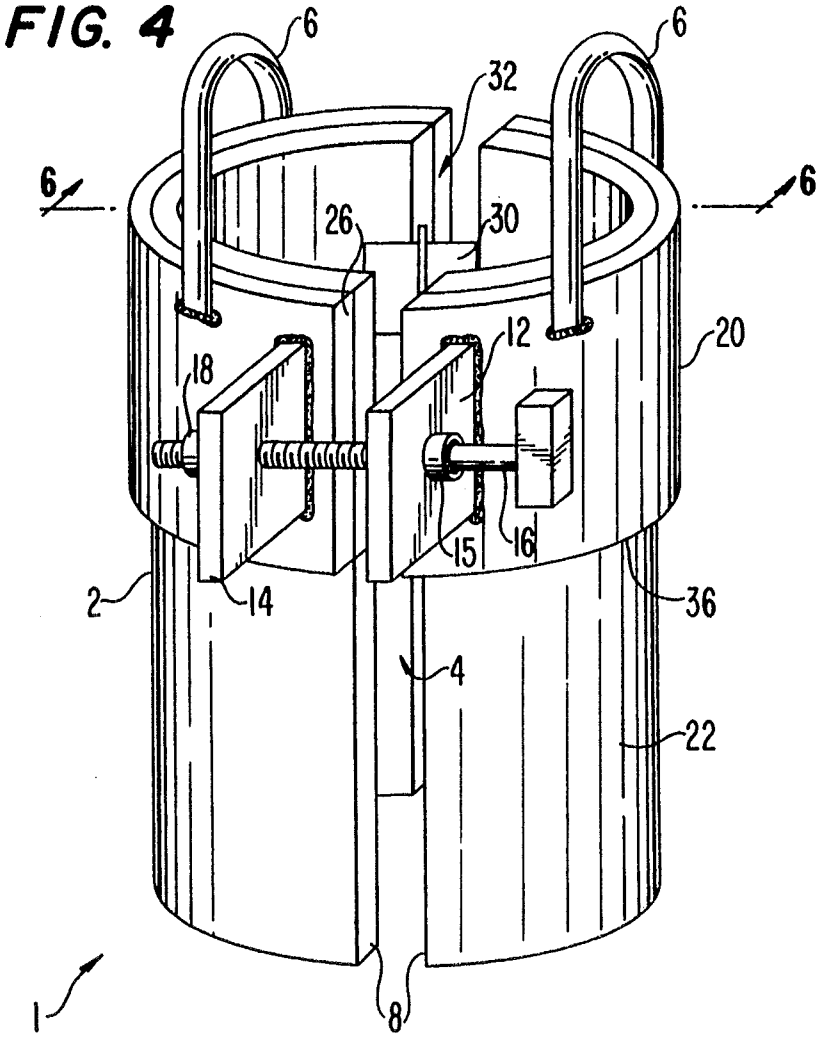
FIG. 4 is a perspective view of a fourth embodiment of the invention.
Figure 6:
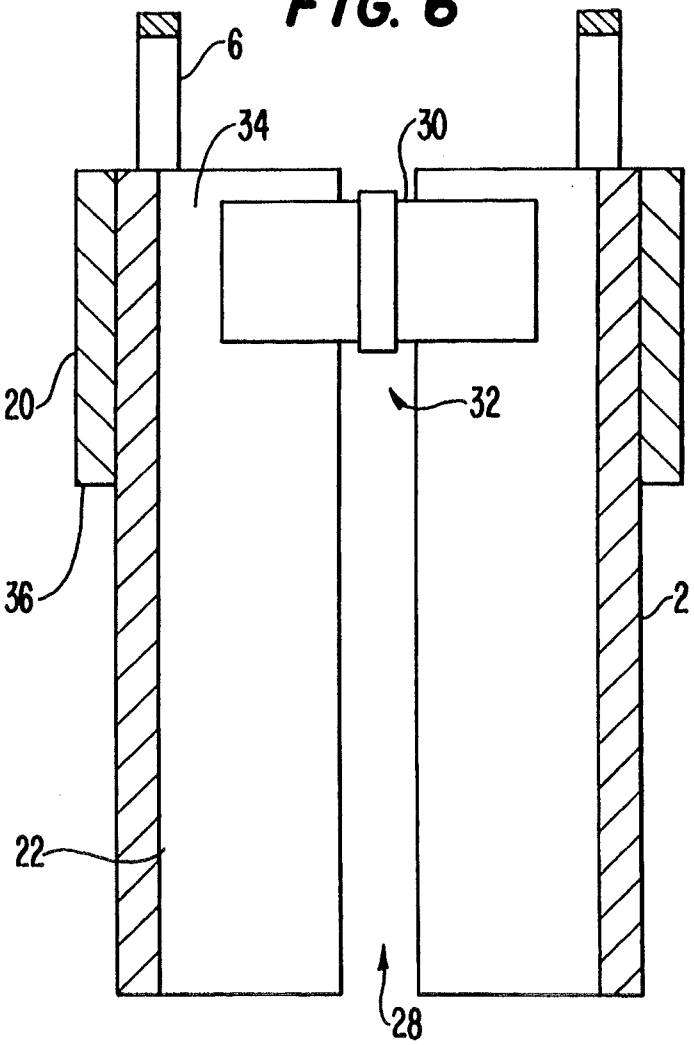
FIG. 6 is a cross-sectional view taken along the plane 6—6 of FIG. 4.

A fourth embodiment is shown in FIGS. 4 and 6. The embodiment of FIGS. 4 and 6 includes the addition of a third split portion 28 in the first shell 2, a fourth split portion 32 in the second shell 20, and a hinge 30. The third and fourth split portions 28, 32 are located opposite the first and second split portions 4, 24, respectively. It is also possible to locate the third and fourth split portions 28, 32 at various other positions on the first and second shells 2, 20.

A hinge 30 is located at either the third split portion 28 or the fourth split portion 32. If the hinge 30 is located at the third split portion 28, then the hinge 30 is attached to an upper part 34 of the first shell 2 on an interior surface thereof, as shown in FIGS. 4 and 6. If the hinge 30 is located at the fourth portion 32, then the hinge 30 is attached to an upper part of the second shell 20 on an exterior surface thereof. In any event, the hinge 30 should be located far enough above the lower part 22 of the first shell 2 so as not to inhibit penetration of the shell 2 into the cylindrical space left by the drill bit.

The operation of the embodiment shown in FIGS. 4 and 6 is similar to that of the embodiment of FIG. 3. In the embodiment of FIG. 4, the shells 2 and 20 are not required to elastically deform in order to grip the core sample, because the hinge 30 allows the shells to move inward.

The use of the hinge 30 in the embodiments of FIGS. 3 and 4 allows less force to be used when tightening the clamping screw 16.

By way of example, the first shell 2 is made of 3/32 inch plate rolled to 5 and 15/16 inch outside diameter. The second shell 20 is made of $\frac{1}{8}$ inch plate rolled to 6 and $\frac{1}{4}$ inch outside diameter. The second shell is attached to the first shell by welding. The length of the second shell is 4 inches. The overall length of the first shell is from 6 to 10 inches. The clamping screw 16 and nuts 15, 18 are $\frac{1}{2}$ inch in diameter. All materials used are commercially available and the fabrication techniques are conventional.

Figure 7:
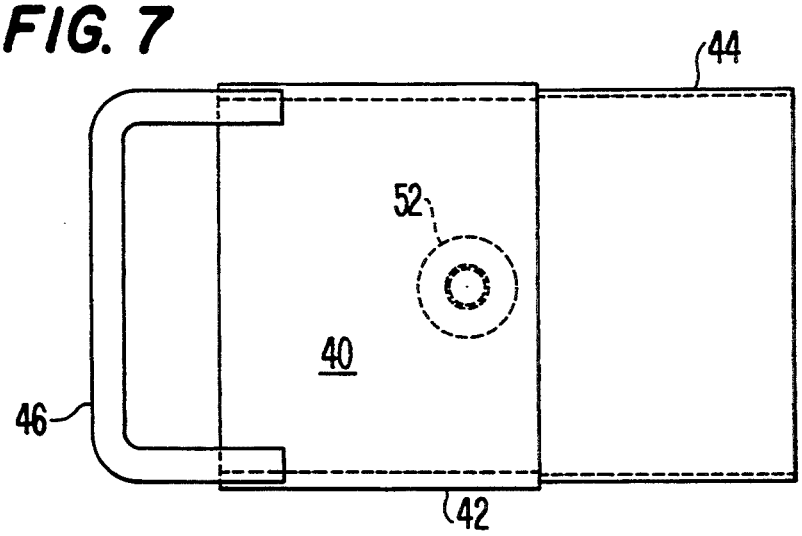
FIG. 7 is side view of a fifth embodiment of the invention.
Figure 8:
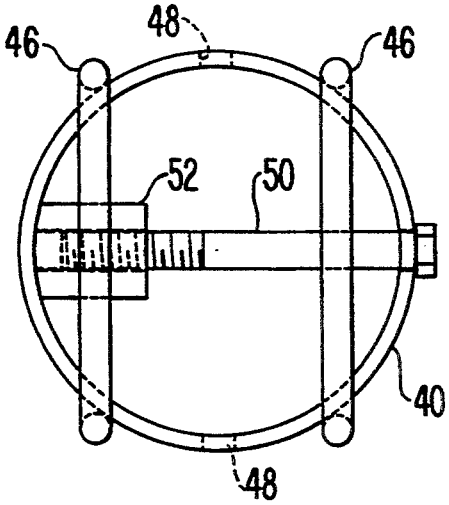
FIG. 8 is an end view of FIG. 7.
Figure 9:
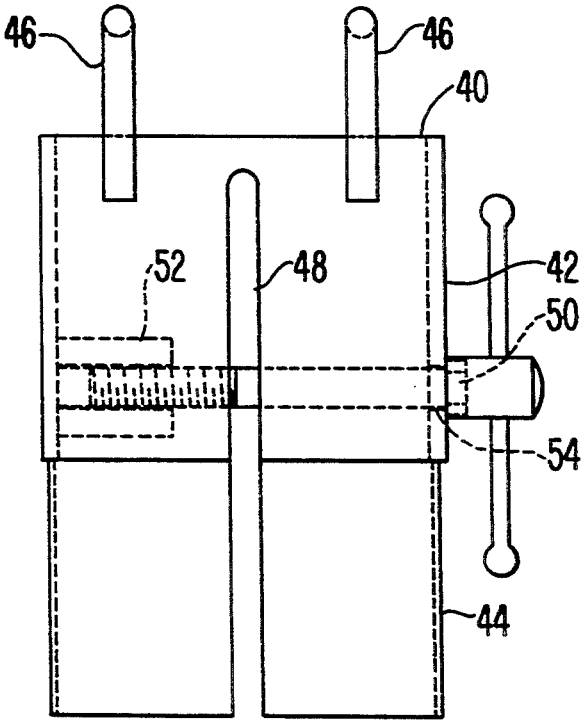
FIG. 9 is an elevation view of the fifth embodiment.

FIGS. 7–9 illustrate a fifth embodiment of the present invention. The split shell 40 includes upper and lower portions 42, 44, respectively. The length of the lower portion 44 can be varied but must be long enough to fit around the core to be pulled. Therefore, the length of the lower portion 44 depends on the depth of the cores to be pulled. This length is conveniently made to be 2 to 6 inches.

At least one handle 46 is attached to the upper portion 42 of the shell 40. For ease of handling, two handles 46 may be provided.

The shell 40 includes two split portions 48, 48 located approximately opposite each other around the circumference of the split shell 40. As shown in FIG. 9, the split portions 48 do not extend over the entire length of the shell 40, but end in a smooth radius near the top of the upper portion 42.

The lower portion 44 of the shell 40 is tightened around a core to be pulled by a nut and bolt arrangement. A nut 52 is attached by, for example, welding, to an interior surface of the upper portion 42. A bolt 50 is fitted through a hole 54 cut in the upper portion 42. The bolt 50 is threaded into the nut 52. When it is desired to tighten the core puller around a core, the bolt 50 is advanced into the nut 52 thereby tightening the shell 40 around the core to be pulled.

By way of example, the shell 40 is made of seamless steel tubing. A tube having 6.25 inch outside diameter and 5.75 inch inside diameter and 9 inches long may be used. In order that the lower portion 44 will fit into a space created by a standard six inch drill bit, the outside diameter of the tube is machined down to 6.05 inches and the inside diameter of the tube is machined to 5.85 inches. The width of the split portions 48 is about ½ inch. The split portions 48 terminate about ½ inch from the top surface of the upper portion 42 in a ¼ inch radius. The bolt 50 may be a ⅝ inch, 5 inch long bolt. The nut 52 is sized to receive the bolt 50 and is about 1¾ inches long. The bolt, nut and handles are also conveniently made of steel.

FIGS. 7–9 show the upper portion 42 having a greater thickness than the lower portion 44 because of the above-described machining operation required to fit the lower portion 44 into the standard 6 inch diameter core space. However, it is also possible that tubing of the standard size of the core drill bit can be produced thereby eliminating any machining required for the lower portion 44. In that case, the thicknesses of the upper portion 42 and the lower portion 44 would be the same.

Although the drawings and the description refer to the shells 2, 20 and 40 as cylindrical, the invention is not limited to cylindrical shells. The shells may have any geometry which allows them to be fitted into the space left by a drill bit.

The embodiments of the present invention shown and discussed are by way of illustration and not of limitation, and a wide variety of equivalent embodiments may be made without departing from the spirit or scope of the invention.

What is claimed is:

1. A core puller for pulling a core surrounded by a space, comprising:

a first split shell including a first split portion and confronting ends;

at least one handle attached to the first shell; and a tightening device for moving the confronting ends of the first shell towards each other, the tightening device being located on an upper part of the first shell; wherein a lower part of the first shell is free from external obstructions thereby allowing insertion of the lower part into the space; and wherein the first split shell further comprises a second split portion wherein the first and second split portions extend only partially along the length of the first split shell; and wherein the tightening device comprises a nut attached to an interior surface of the upper part of the first shell and a bolt fitted through a hole in the upper part of the first shell and threadingly engaging the nut.

* * * * *

UNITED STATES PATENT AND TRADEMARK OFFICE

CERTIFICATE OF CORRECTION

PATENT NO. : 5,431,466

DATED : July 11, 1995

INVENTOR(S) : Thomas Daniel RICHARDSON, Jr.

It is certified that error appears in the above-indentified patent and that said Letters Patent is hereby corrected as shown below:

Column 1, line 23, "1 1/2" should read —1-12—.

Signed and Sealed this

Tenth Day of October, 1995

*Attest:*

Bruce Lehman

BRUCE LEHMAN

*Attesting Officer*

*Commissioner of Patents and Trademarks*